US010286284B2

(12) United States Patent
Bentley

(10) Patent No.: US 10,286,284 B2
(45) Date of Patent: May 14, 2019

(54) GOLF TRAINING DEVICE

(71) Applicant: Joseph Richard Bentley, Harvard, IL (US)

(72) Inventor: Joseph Richard Bentley, Harvard, IL (US)

( * ) Notice: Subject to any disclaimer, the term of this patent is extended or adjusted under 35 U.S.C. 154(b) by 0 days.

(21) Appl. No.: 16/102,090

(22) Filed: Aug. 13, 2018

(65) Prior Publication Data

US 2019/0054361 A1 Feb. 21, 2019

Related U.S. Application Data

(60) Provisional application No. 62/547,217, filed on Aug. 18, 2017.

(51) Int. Cl.
*A63B 69/36* (2006.01)

(52) U.S. Cl.
CPC ..... *A63B 69/3608* (2013.01); *A63B 69/3632* (2013.01); *A63B 69/3647* (2013.01); *A63B 2225/09* (2013.01)

(58) Field of Classification Search
CPC ..... A63B 69/3608; A63B 69/3647; A63B 2225/09; A63B 69/3632
See application file for complete search history.

(56) References Cited

U.S. PATENT DOCUMENTS 4,030,732 A * 6/1977 Vincent ..... A63B 21/0004 473/229
4,662,640 A * 5/1987 Grander ..... A63B 21/0552 473/215
7,156,748 B2 1/2007 Burke
2011/0218084 A1* 9/2011 Doherty ..... A63B 21/02 482/122

* cited by examiner

*Primary Examiner* — Eugene L Kim
*Assistant Examiner* — Jeffrey S Vanderveen
(74) *Attorney, Agent, or Firm* — Steven H Greenfield; Greenfield Invention and Patent Consulting, Inc.

(57) ABSTRACT

A golf training device comprises a first elastic band loop attached to a strap wrapped around the lead shoulder of the golfer at one end and to the shaft of the golf club at the other end and also comprises a second elastic band loop attached to a strap wrapped around the lead shoulder of the golfer at one end and to the butt end of the grip of the golf club at the other end. When the golfer extends his or her arms to swing the golf club, the resistance provided by the rubber bands helps guide the golfer's swing by informing the proper location of the arms and hands of the golfer relative to the body for maximum leverage throughout the golf swing.

8 Claims, 6 Drawing Sheets

GOLF TRAINING DEVICE

RELATED APPLICATIONS

This application claims priority from provisional application 62/547,217 filed on Aug. 18, 2017.

FIELD OF THE INVENTION

The present invention relates to a golf training device for the purpose of training the golfer to produce acceleration of the golf club along the intended line of play through the use of properly applied leverage during the golf stroke and for aiding in the proper set-up and in-swing fundamentals of the grip, stance, ball position, alignment and posture necessary to achieve a proper swing.

BACKGROUND OF THE INVENTION

The golf stroke is a compound leverage motion. The lead shoulder acts as the primary fulcrum with the body providing the input and the lead arm and club moving as the output. The trailing forearm and hand act as a secondary fulcrum in which the connection point of the butt of the club to the lead arm, held by the grip, acts as the input and the golf club shaft below the base of the trailing forefinger, the connection point of the trailing forearm and the hand to the golf club, moves as the output. The primary leverage motion moves the leading arm. The secondary leverage motion moves the golf shaft with respect to the leading arm. The secondary lever will exert its force causing the club to release either with centrifugal force at the bottom of the swing arc, a weak release, or when the trailing arm becomes braced against the body so as to provide a foundation for the secondary fulcrum, a strong release. The release of the club creates acceleration which flexes the golf shaft and causes the shaft to retain energy. When done correctly, this energy is imparted to the golf ball at impact. To be effective, the golf stroke requires proper alignment of the secondary lever relative to the primary fulcrum and the primary lever relative to the ball and the intended line of play. Failure to maintain proper alignment throughout the golf stroke can result in a loss of power or a need to make undesirable compensations to accommodate an improper release.

Currently, there is no device, drill or exercise known to the inventor that adequately demonstrates the proper motion of the golf swing as described above. The device of the present invention helps inform the golfer the location of his or her arms and hands relative to the body in the course of swinging a golf club for maximum leverage throughout the golf swing.

SUMMARY OF THE PRESENT INVENTION

The summary of the invention as follows is based on the current preferred method of production of the device and in no way seeks to make any claim nor to limit that which is claimed in the claims section.

The device comprises a shoulder harness with two adjustable straps that are wrapped around each shoulder of the golfer for best fit. Two stretchable resistance bands are then attached to the golf club, one beneath the heel pad of the lead hand as it is gripping the golf club and the other to the golf shaft between the golf grip and club head, so that a slight stretch of both bands is achieved when the golf club is held in the lead hand while standing erect, with the lead arm straight and comfortably resting to the side of the body with the golf shaft resting in front of the body parallel to the shoulders and parallel to the ground and the golf club shaft resting on the body just below the waist.

Once properly fitted the golfer adds his trailing hand to the grip and takes an address position, i.e., the position the golfer sets up to take a swing. The device is used in making slow motion swings of various lengths, swings made of various lengths hitting into an impact bag and short swings used in pitching and chipping while actually hitting golf balls. The device will emphasize the proper fundamentals and in swing alignment necessary for the achievement of the proper strong release of the golf club. In particular, the device will help to keep the trailing elbow in front of the trailing hip on the downswing and the hands ahead of the ball at impact while at the same time making a full release of the golf club through impact, all of which are key elements of an ideal strong release. Failure to maintain proper swing alignment throughout the golf swing will result in either a weak release or the release of the golf club at a point other than the desired point of release through impact. By referencing the secondary leverage motion back to the primary fulcrum, or lead shoulder, the device allows the golfer to feel and experience a strong release of the golf club and demonstrates how their fundamentals of grip, stance, ball position, alignment and posture affect where that release is being made relative to the desired point of release through impact. The golfer can then adjust the positioning of their grip, stance, ball position, alignment and posture to cause the release to occur properly through impact.

In an aspect of the present invention, a golf training device for a golfer swinging a golf club, the golf club containing a shaft, a head and a grip, the golfer having a lead shoulder and a trailing shoulder, the training device comprises: a first elastic band loop attached at a first end to a point above a midsection of the golfer's body, the first elastic band loop being attached at a second end to the shaft of the golf club; and a second elastic band loop attached at a first end to a point above a midsection of the golfer's body, the second elastic band loop being attached at a second end to a butt end of the grip.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention.

Figure 1:
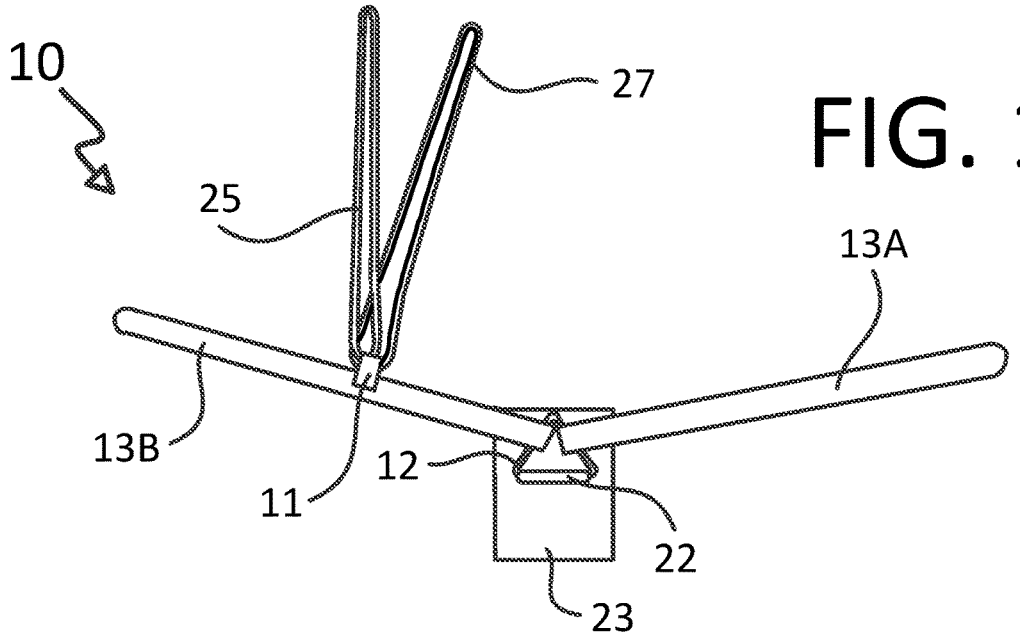
FIG. 1 presents a rear view of the golf training device in a folded position according to an embodiment of the present invention.
Figure 2:
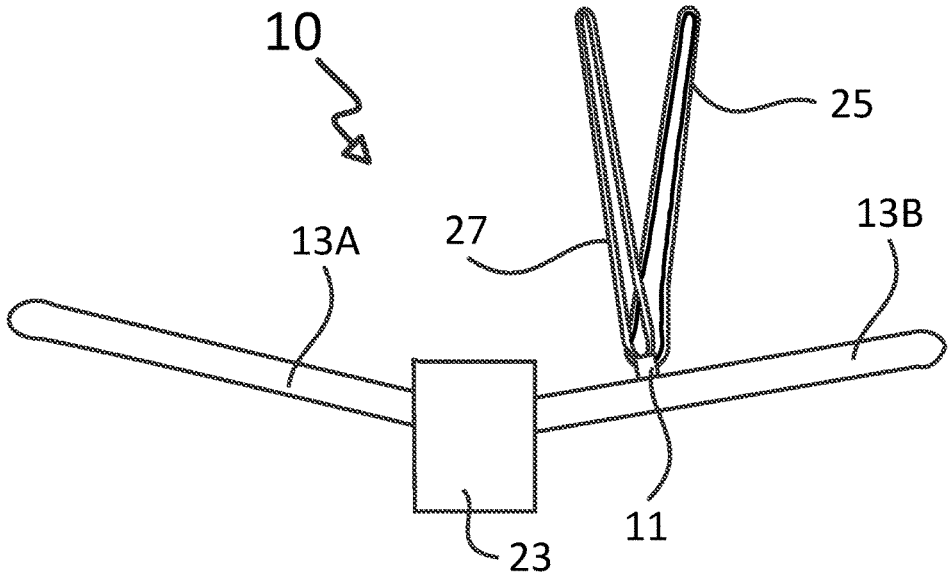
FIG. 2 illustrates a front view of the golf training device of the present invention in a folded position.
Figure 3:
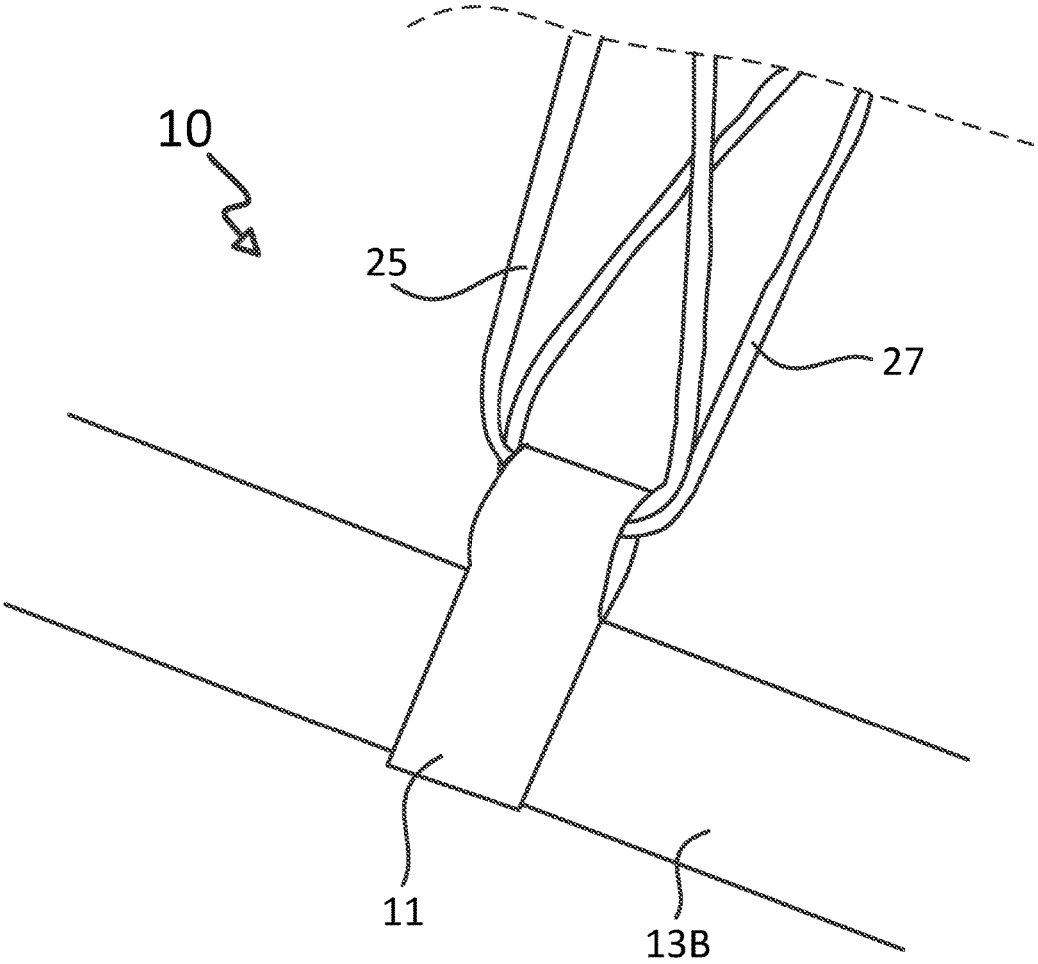
FIG. 3 portrays a component of the golf training device of the present invention.
Figure 4:
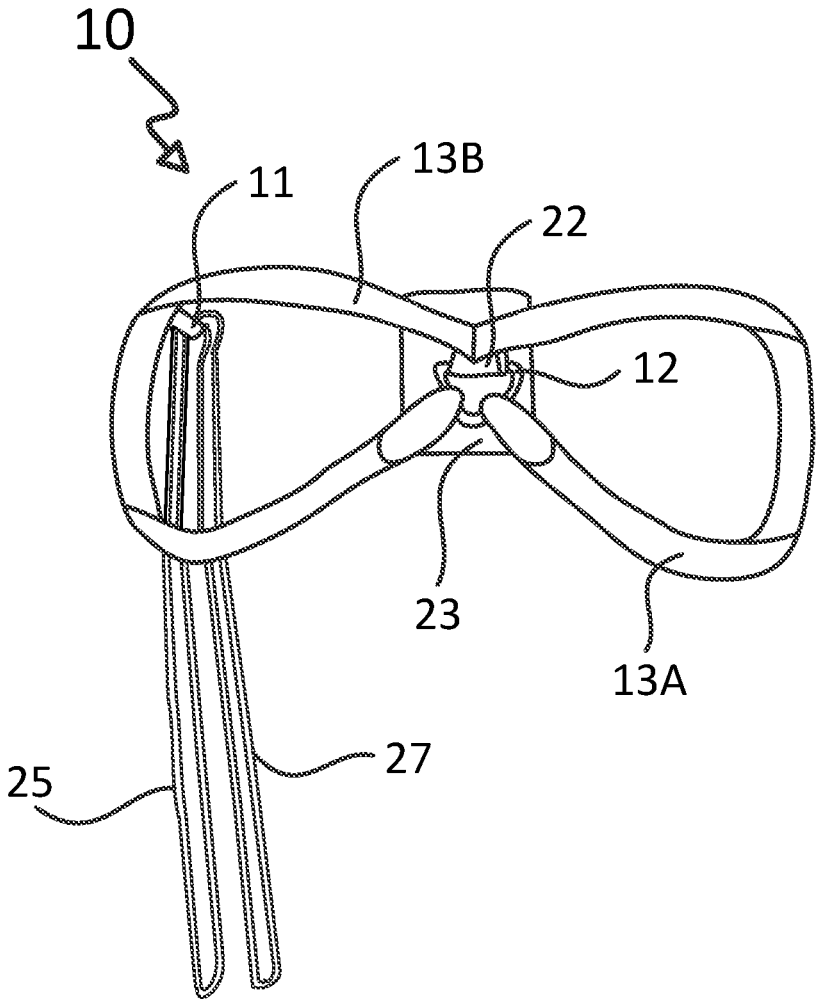
FIG. 4 is a rear view of the golf training device in an unfolded position.
Figure 5:
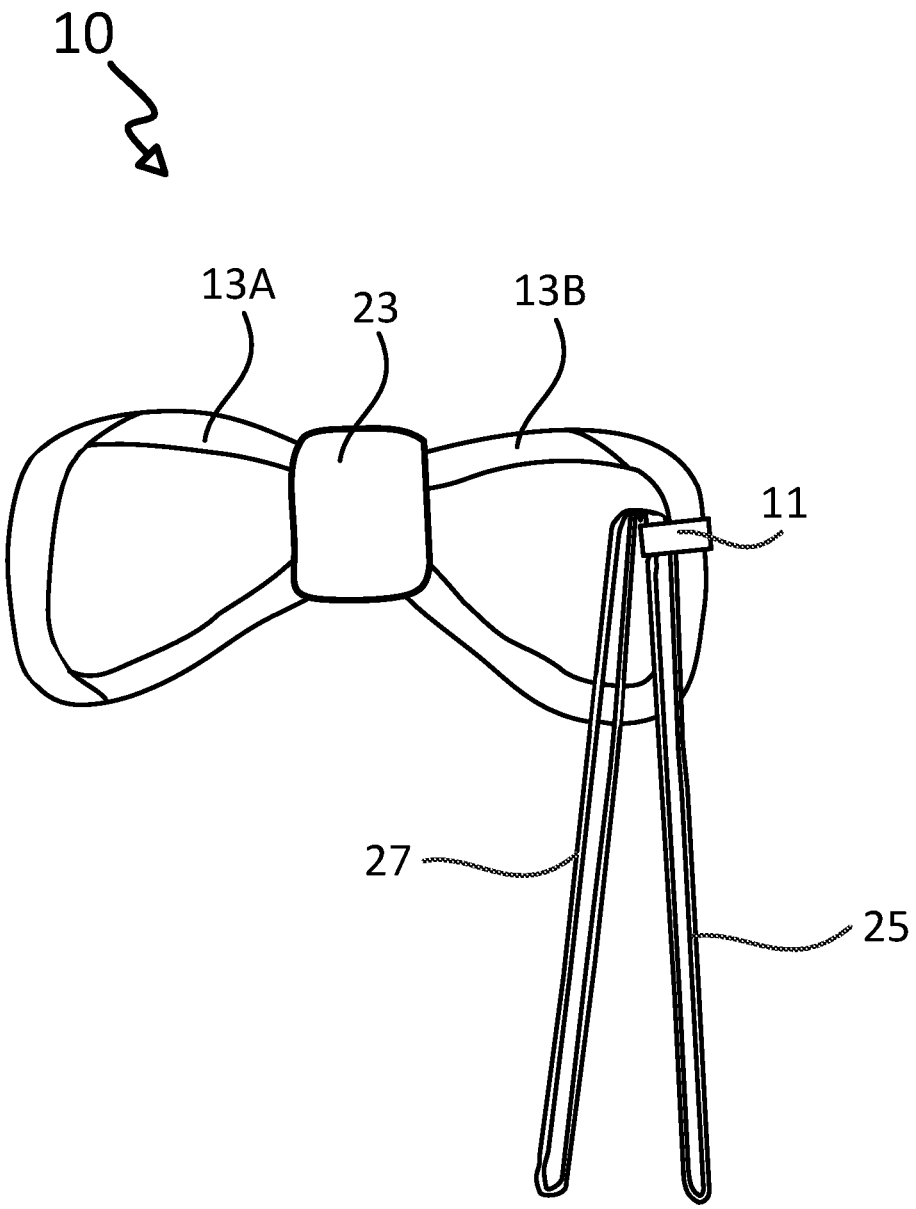
FIG. 5 shows a front view of the golf training device in an unfolded position.
Figure 6:
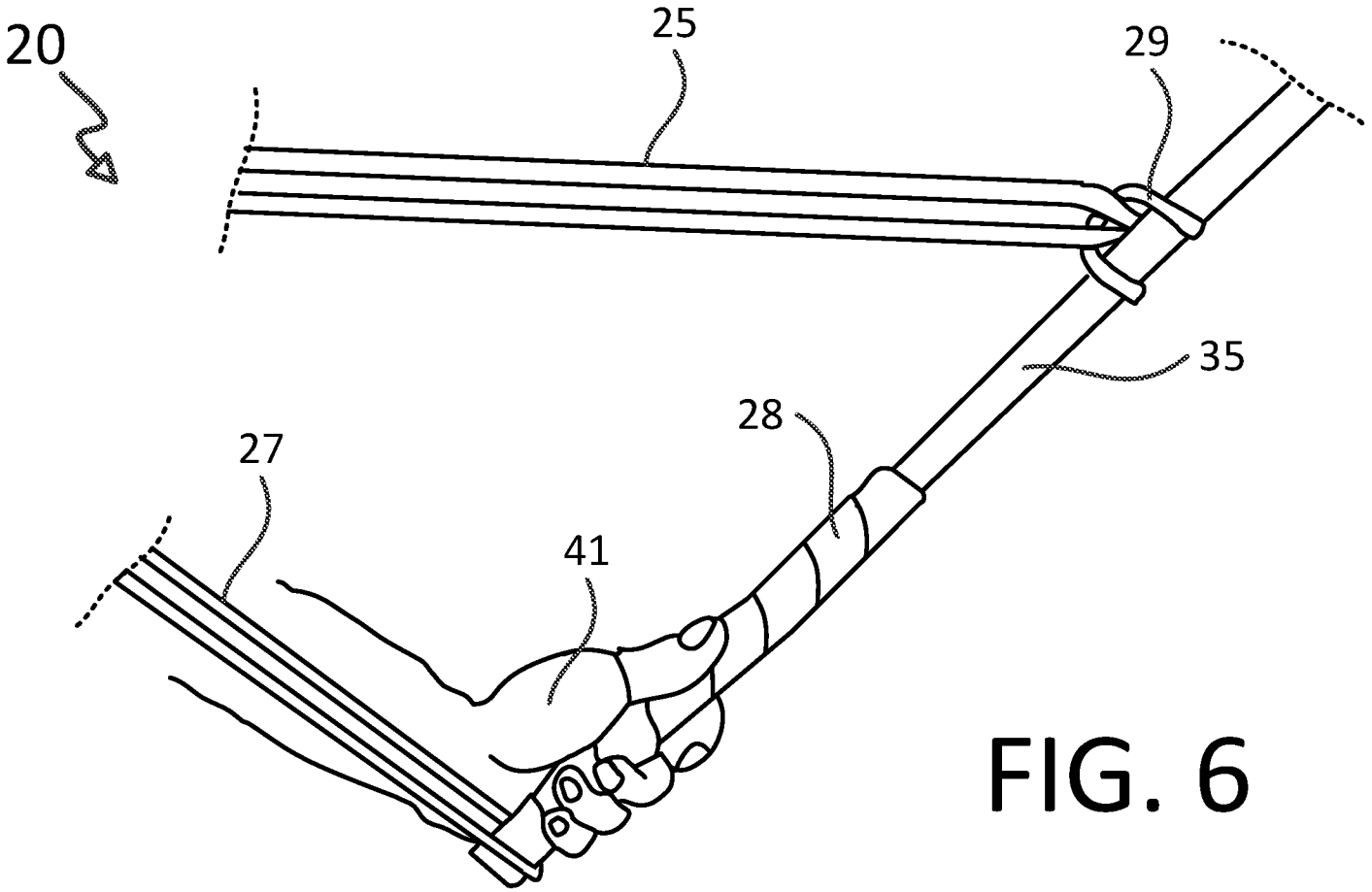
FIG. 6 is a close-up view of the device being held by a user in the course of using the device of the present invention.
Figure 7:
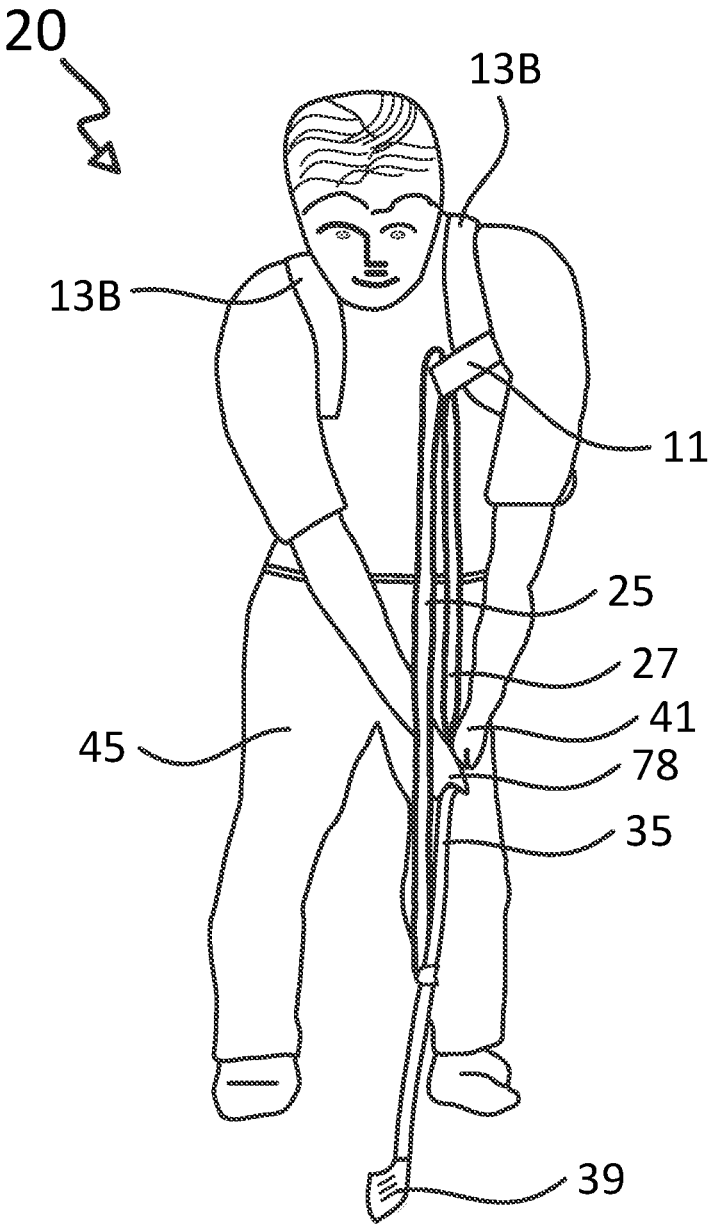
FIG. 7 is a front view of a golfer using the device of the present invention.

The device 10 is depicted in FIGS. 1-5 and a use configuration 20 is illustrated in FIGS. 6 and 7. The device 10 comprises a harness that the golfer 45 wears on his or her shoulders. The harness has a right shoulders strap 13A and left shoulder strap 13B that wrap around the golfers arms. The harness contains a mounting pad 23 at its center to which the right shoulders straps 13A and left shoulder straps 13B are attached via triangular shaped ring 12 that is attached to material piece 22 that is in turn attached to the mounting pad 23. A golfer 45 typically has a lead arm which is the left arm for a right handed golfer or the right arm for a left handed golfer.

The left shoulder strap contains a channel 11 through which a first elastic band loop 25 and a second elastic band loop 27 are threaded as shown in FIG. 7. It is noted that the lead arm of the golfer depicted in FIG. 7 is the left arm; however, if the golfer's right arm was the lead arm, the channel 11 that contains the first elastic band loop 25 and a second elastic band loop 27 would be attached to the right shoulder strap.

The channel 11 is configured to secure a first end of the elastic band loop 25 and a first end of elastic band loop 27 in place and may be made of fabric, cloth or other suitable materials such as plastic. It should be noted that other attachment mediums of the elastic band loops 25 and 27 to the body of the golfer also fall within the scope of the present invention. These include but not limited to attachment to any article of clothing worn by the golfer as well as addition sewn to the clothing of the golfer.

The second unattached opposing end of the first elastic band loop 25 is attached to about a midpoint of a golf club 35; however the attachment point of the first elastic band loop 25 may be placed anywhere on the shaft 35 of the golf club and span from just above the head of the golf club 39 to below the grip of the golf club 28. The second unattached opposing end of the second elastic band loop 27 is attached to the butt end of the grip of the golf club 28 as shown in FIG. 6; however, an attachment to any part of the grip falls within the scope of the present invention. The preferred attachment point for the second end of the first elastic band loop 25 is the middle one third of the shaft 35 between the head 39 and grip 28. The second elastic band loop 27 attachment to the butt end of the grip of the golf club 28 may be placed under the hand of the golfer placed on the grip 28 of the golf club 35 as illustrated in FIG. 6.

The length of the first elastic band loop 25 and the second elastic band loop 27 is adjusted in such a way that their attachment to the shaft 35 of the golf club and to the butt end of the grip of the golf club 28 result in extending the first elastic band loop 25 and the second elastic band loop 27 by 5 inches to about 20 and in a resistance force of 1 lbs. to about 5 lbs. The golfer may vary band extension levels in the course of training to a level that the golfer deems useful and comfortable.

The attachment of the second end of the first elastic band loop 25 to the shaft 35 of the golf club may be done using a slip knot 29 as shown in FIG. 6; however other means of attachment such as a tie knot, tape and Velcro also fall within the scope of the present invention.

The attachment of the second end of the second elastic band loop 27 to the grip of the golf club 28 may be done by looping it around the grip of the golf club 28 and securing the attached end with the golfer's lead hand 41 as shown in FIG. 6. However, other means of attachment such as a tie knot, tape and Velcro also fall within the scope of the present invention. As shown in FIG. 7, the golfer's trailing hand 78 is placed on the grip below the lead hand 41.

FIG. 7 shows a golfer 45 in the address position using the device 10 in which the elastic loop bands 25 and 27 are attached to the golf club 35. The attachment of the elastic bands serves to guide the swing and to inform the location of the arms and hands of the golfer 45 relative to the body and to provide maximum leverage throughout the golf swing.

Since golf players very in height, ability and strength, the lengths and elongation resistance characteristics of the first elastic band loop 25 and the second elastic band loop 27 may need to be adjusted to suit the specific needs of each golfer. Generally, the length of each elastic band loop will be about 17 inches with a range of about 12-22 inches and elasticity characteristics in the range of about a 2.0 inch to about 6.5 inch extension for each lb. of applied extension force applied to the bands and preferably in the range of 3.0 inch to about 4.0 inch extension for each lb. of applied extension force applied to the bands. Length adjustments may be done by the golfer to the bands by tying the elastic band loops into a knot.

I claim:

1. A golf training device for a golfer swinging a golf club, the golf club containing a shaft, a head and a grip, the golfer having a lead shoulder and a trailing shoulder, said training device comprising:

a first elastic band loop configured to be attached at a first end to a point above a midsection of the golfer's body, said first elastic band loop being attached at a second end to the shaft of the golf club; and a second elastic band loop configured to be attached at a first end to a point above a midsection of the golfer's body, said second elastic band loop being attached at a second end to a butt end of the grip, wherein the first elastic band loop extends 2.0 inches to 6.5 inches per lb. of extension force applied to the first elastic band loop and provide resistance in a range of 1 to 5 lbs. of force and wherein the second elastic band loop extends 2.0 inches to 6.5 inches per lb. of extension force applied to the first elastic band loop and provide resistance in a range of 1 to 5 lbs. of force.

2. The golf training device of claim 1 further comprising a shoulder harness worn by the golfer, the shoulder harness containing a first strap wrapping around the golfer's lead shoulder and a second strap wrapping around the golfer's trailing shoulder, the first elastic band loop being attached at the first end to the first strap of the shoulder harness.

3. The golf training device of claim 2 wherein the first end of the second elastic band loop is attached to the first strap of the shoulder harness.

4. The golf training device of claim 1 wherein the first end of the first elastic band loop and the first end of the second elastic band loop are threaded through a channel attached to the first strap of the harness.

5. The golf training device of claim 1 wherein the second end of the first elastic band loop is attached at a middle one third of the golf club shaft.

6. The golf training device of claim 1 wherein an attachment of the second end of the second elastic band loop to the grip of the golf club is held in place under a hand of the golfer, the second end of the second elastic band being held under the hand of the golfer.

7. The golf training device of claim 1 wherein the first elastic band loop extends 3.0 inches to 4.0 inches per lb. of extension force applied to the first elastic band loop and provide resistance in a range of 3 to 4 lbs. of force.

8. The golf training device of claim 1 wherein the second elastic band loop extends 3.0 inches to 4.0 inches per lb. of extension force applied to the first elastic band loop and provide resistance in a range of 3 to 4 lbs. of force.

* * * * *